United States Patent [19]

Danguy des Deserts et al.

[11] Patent Number: 4,684,292

[45] Date of Patent: Aug. 4, 1987

[54] OSCILLATING PLATFORM ON FLEXIBLE PILES FOR WORK AT SEA

[75] Inventors: Loic M. J. Danguy des Deserts; Dominique Michel, both of Paris; Francois G. Sedillot, Velizy, all of France

[73] Assignee: Doris Engineering, France

[21] Appl. No.: 764,604

[22] Filed: Aug. 12, 1985

[51] Int. Cl.[4] ..... E02B 17/02

[52] U.S. Cl. ..... 405/202; 405/227

[58] Field of Search ..... 405/202, 227, 195, 203, 405/205, 207, 224

[56] References Cited

U.S. PATENT DOCUMENTS 3,670,515 6/1972 Lloyd ..... 405/202
4,127,003 11/1978 Vilain ..... 405/202
4,363,568 12/1982 Schuh ..... 405/227
4,421,438 12/1983 Abbott et al. ..... 405/227

FOREIGN PATENT DOCUMENTS 1448802 10/1965 France .
2075096 11/1981 United Kingdom .
2123833 2/1984 United Kingdom .

*Primary Examiner*—David H. Corbin
*Attorney, Agent, or Firm*—Wigman & Cohen

[57] ABSTRACT

Flexible piles (5) are arranged close to the center of the tower (1) and evenly spaced apart on a circumference the area of which is about 10% of the area of the tower. The product of the total buoyancy of the tower by the arm level between the buoyancy center and the center of the articulation is at least equal to 1.25 times the product of the weight of the platform by the arm level between the center of gravity and the center of the articulation.

7 Claims, 9 Drawing Figures

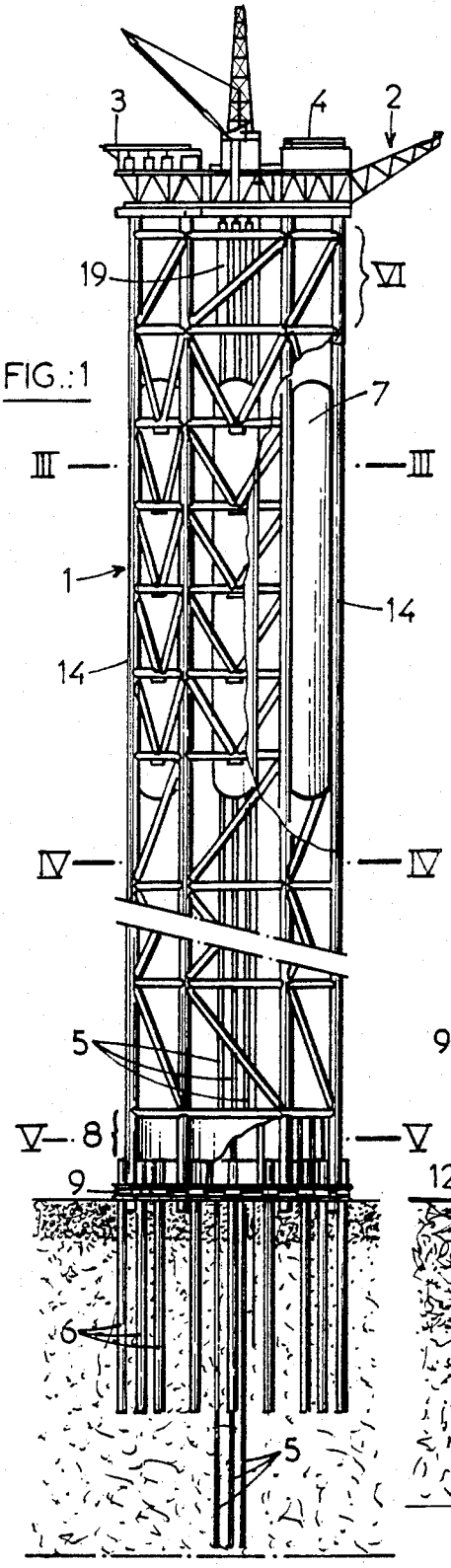
FIG.:1
FIG.:3
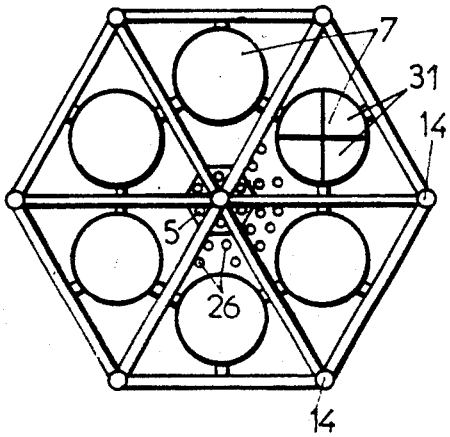
FIG.:2
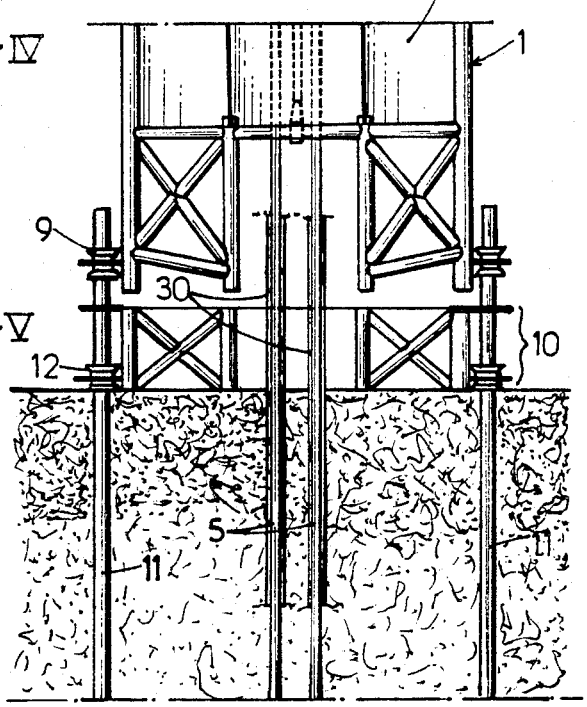

OSCILLATING PLATFORM ON FLEXIBLE PILES FOR WORK AT SEA

BACKGROUND OF THE INVENTION

The invention relates to an oscillating platform on flexible piles for work at sea, the piles being fixed to the upper part of the lattice tower and being driven into the sea bottom so as to maintain the tower; means being provided for resisting tower twistings movements.

Oscillating platforms in which the articulation connecting the base to the lower end of the tower has been eliminated and replaced by a number of piles driven into the sea bed and extending to the upper part of the tower to which they are secured, are known. Such a platform is disclosed in U.S. Pat. No. 4,417,831. In this construction, the piles extend freely within a number of legs of the tower or in guides fixed to the bracings. The tower is anchored to the sea bottom by guying, so as to ensure that the current and wave effects have not an excessive influence on the lateral movements of the tower.

Permanent floaters may be used for supporting part of the weight of the deck, and more particularly for resisting excessive loads and forces in the piles during strong storms. They are unnecessary under normal environmental conditions.

When the platform is used to put in production pre-drilled wells from a sub-sea template, anchoring piles of the template are provided for receiving some of the legs of the tower. The purpose of this attachment is to avoid torque resulting from a dissymetry of the forces (wind, current, etc.) applied to the tower.

Such guyed platforms, articulated to flexible piles have allowed a reduction in the masses, and therefore costs, owing to the elimination of the articulation (universal or swivel joints) and its supporting base. On the other hand, the guying system required for the stability led to multiply the number of anchoring points and to increase the maintenance requirements. The control of the torque effect through part of the legs of the tower induces dissymmetrical forces in the structure which result in an absornal fatigue in some elements and adverse effects on the life of the structure.

SUMMARY OF THE INVENTION

The object of the invention is to provide an oscillating platform having flexible piles of the type described hereinbefore, but in which the guying system has been eliminated and the torque forces are symmetrically and equally distributed between the structural elements of the tower.

As the guying system was considered to be essential to ensure stability of "guyed towers", the invention has consisted in the determination of the conditions under which the system could be eliminated. the determination of these conditions required a large amount of experimental work taking into account in particular the action of currents, of winds and waves on a structure installed in water depths exceeding 300 meters. It has been discovered that, under the conditions which are listed hereinafter, and contrarily to recognized opinions according to the invention, the oscillations of a platform remains within a solid angle of very low amplitude (2°-3°), irrespective of the conditions of the environment and no amplification phenomena can be produced.

For the platform according to the invention, the product of the total buoyancy (immersed structure floaters) by the distance between the buoyancy center and the center of the articulation must be at least equal to 1.25 times the product of the weight of the platform (structure, floaters, ballast, deck, etc.) by the distance between the center of gravity of the platform and the center of the articulation.

BRIEF DESCRIPTION OF THE DRAWINGS

The following description with reference to the here after attached drawings presented merely by way of example will allow to understand how the invention can be achieved.

FIG. 1 is an elevation view, partly in section, of a platform according to the invention.

FIG. 2 is a view of the lower part of a platform according to another embodiment of the invention.

FIG. 3 is a section view from line III—III of FIG. 1.

FIG. 1 is an elevation and partly a section view of a platform according to the invention. This platform is composed of a lattice tower 1 supporting at the upper part a deck 2 fitted with drilling equipment 3 and living quarters 4. The tower is connected to the sea bottom by means of an articulation made of flexible piles 5 arranged on a circle and parallel to the axis of the tower close to the latter, and by shear piles 6 arranged on the periphery of the tower, the function of which will be defined hereinafter.

Figure 4:
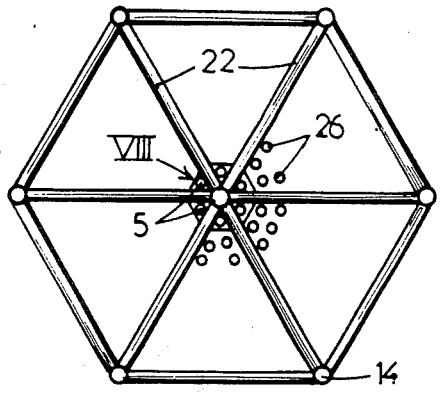
FIG. 4 is a section view from line IV—IV of FIG. 1.

The flexible piles 5, which are six in number in the illustrated embodiment, are arranged close to the center of the tower on a circumference the diameter of which defines an area approximately equal to, or less than, 10% of the total area of the structure. This very compact arrangement affords several advantages:

the tensile and compression forces in diametrically opposed piles, induced by oscillations around the articulation point located at the sea bed level, are reduced to a minimum;

the drilling or conducting tubes are protected near the sea surface owing to the fact that they extend within the tower and are subject to small stresses at sea bed level owing to their short distance from the axis of the tower.

The tower is provided in its upper part with floaters 7 and in its lower part with a ballast compartment 8, illustrated in FIG. 1 with its lateral steel plates partially removed for enlightenment purposes.

According to the embodiment shown on FIG. 1, the periphery of the lower end lateral of the tower is fitted with guides 9 which receive shear piles 6 preventing the rotation of the tower around its axis and permitting the transfer of the shear forces and the torsional moments to the ground.

According to the embodiment presented on FIG. 2, the tower is installed on top of a template 10 supporting the pre-drilled well heads. The template comprises a lattice structure fixed to the sea bed by fixing piles 11. The piles are welded in guides 12 fitted to the lattice structure in accordance with a lay-out indentical to that of the lateral guides 9 arranged at the lower part of the tower. The upper part of the fixing piles 11 extends above the top level of the template so as to receive the lateral guides 9 of the tower. A gap of 1 to 2 meters provided between the bottom of the tower and the upper level of the template permits free oscillations of the structure.

The volume of the floaters is such that the product of the total buoyancy of the tower (comprising the volume of the immersed structure) by the distance between the buoyancy center and the center of the articulation is at least equal to 1.25 times the product of the weight of the platform (comprising the deck, the structure of the tower, the floaters, the flexible piles, the ballast) by the distance between the center of gravity of the platform and the center of the articulation.

"Tower structure" means all the elements which compose the tower and those included in the tower, i.e. the legs, the bracings, the piles, but also the floaters and the ballast(s), and "platform" means the foregoing tower equipped with the deck.

The well head template which rests directly on the sea bed and which consequently does not intervene in the hydrostatic equilibrium of the platform, is not taken into account in the terms defining the equilibrium conditions established hereinbefore.

The tension or the compression of the flexible piles 5 is induced by the difference between the weight of the platform, including the ballast, and the buoyancy of the structure.

The platform according to the embodiment of the invention is composed of a hexagonal lattice tower the tubular legs 14 of which form the apices. The legs are horizontally and diagonally braced in a conventional manner.

Figure 6:
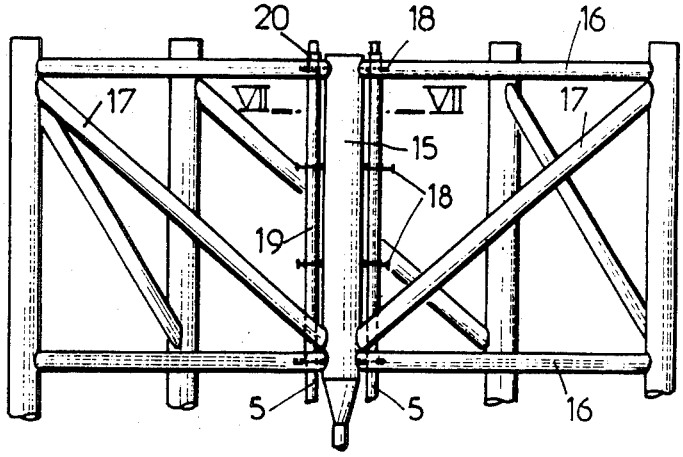
FIG. 6 is partly a section view of the detail VI of FIG. 1 to larger scale.
Figure 7:
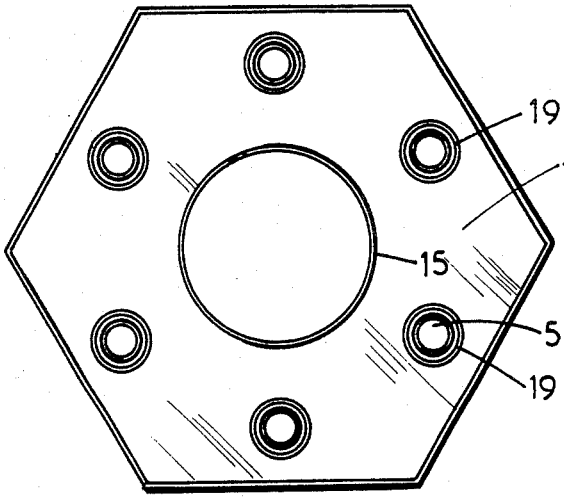
FIG. 7 is a section view from line VII—VII of FIG. 6 to a larger scale.

The upper part VI of the tower, as presented to an enlarged scale on FIG. 6, is partly immersed and comprises a central tube 15 on which the horizontal and diametrical braces 16 and one end of the diagonal braces 17 are welded. Fixing plates 18 (FIG. 7) supporting evenly spaced sleeves 19 in which the flexible piles 5 are guided, are welded to the central tube too.

Figure 8:
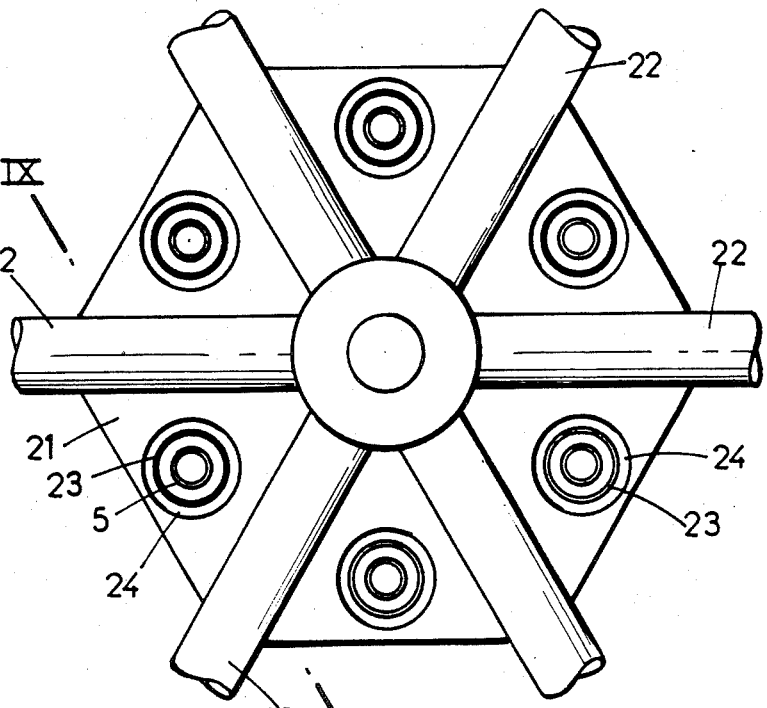
FIG. 8 is a view of the detail VIII of FIG. 4 to a larger scale.
Figure 9:
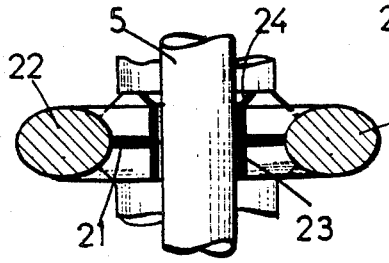
FIG. 9 is a section view from line IX—IX of FIG. 8.

These piles are connected at their upper end to the upper end 20 of the sleeves by welding. The flexible piles 5 are maintained at different points on the height of the tower at level of the horizontal diametrical braces (FIGS. 4, 8 and 9) by gussets 21 welded to the braces 22 and having an opening in their center, in which a tubular guide 23 fitted at its upper end with a conical frustum flange 24 is welded. The diameter of the guide is such as to leave a clearance therebetween and the pile so as to allow a free sliding of the latter.

The floaters 7 provided near to the top of the tower (FIG. 3) are arranged in the spaces defined by the horizontal diametrical braces in which they are at least partly fixed. The volume of the floaters is calculated as a function of the tensile or compression stresses it is desired to apply to the flexible piles. The floaters are segmented into compartments so as to reduce the effects of a possible modification in the buoyancy resulting from damage to one or more floaters.

Figure 5:
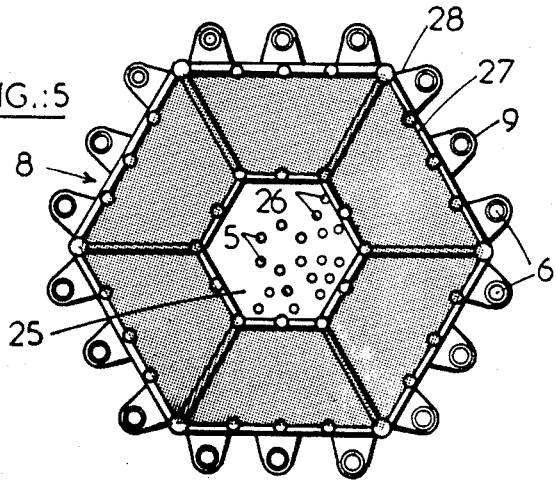
FIG. 5 is a section view from line V—V of FIG. 1.

FIG. 5 is a section view of the tower at the level of the ballast compartment 8. The horizontal braces at the bottom of the compartment provide a hexagonal central opening 25 which defines with the vertical braces a central volume in communication with the sea, in which the flexible piles 5 and the conductor or drilling tubes 26 will extend.

The ballast compartment 8 is limited on its lateral sides and its bottom by closing plates (FIGS. 1 and 2).

On the peripheral horizontal braces 27 provided at the lower end of the tower, a part of the means for balancing of shear forces are evenly spaced apart. They are composed of a number of pad eyes 28 supporting guides 9, through which the shear piles 6 constituting the other part of said means extend.

The flexible piles 5 are driven or bored into the ground so as to transmit the vertical force induced by the environmental forces and possibly from the apparent weight of the structure.

As shown of FIG. 2, the axial resistance capacity of the flexible piles is increased by the addition of a sleeve 30 installed around each pile in the lower part of the tower and driven into the ground. Preferably, the sleeve surrounds only a small part of the length of the flexible pile penetrating the ground. These sleeves enable the compression capacity of the piles to be increased by preventing them from buckling, and protect the piles from wear when passing through the layer of marine deposits.

In a preferred embodiment, the floaters 7 are located as close as possible to the axis of the tower so as to minimize the moment of inertia of the masses about the vertical axis of the tower and to reduce the tendency of the tower to turn about this axis.

The floaters 7 are divided into compartments (FIG. 3) in order to avoid drawbacks due to damaging of a floater. Further, under normal operating conditions the floater contains an amount of water uniformly distributed in compartments 31 and equal to the volume of a compartment. This permits, in the event of an accidental ingress of water, to rapidly restore the stability of the structure by pumping out the water contained in the undamaged compartments.

We claim:

1. An oscillating platform for work at sea, said platform having a weight, comprising a deck, a lattice tower having an upper part and a lower part, said tower further having a total buoyancy center, and a center of gravity, an articulation formed by flexible piles, said articulation having a center; the flexible piles being driven into the sea bed and fixed to the upper part of the tower; the tower comprising floaters in its upper part and a ballast compartment in its lower part, as well as means for resisting shear forces; the product of the total buoyancy of the tower by the distance between the buoyancy center of the tower and the center of the articulation being at least equal to 1.25 times the product of the weight of the platform by the distance between the center of gravity of the platform and the center of the articulation.

2. A platform according to claim 1, wherein the flexible piles are arranged close to the center of the tower and are evenly spaced apart on a circumference to diameter of which defines an area substantially not larger than 10% of the area of the tower.

3. A platform according to claim 1 or 2, wherein the floaters are installed within the structure of the tower and close to the axis of the tower.

4. A platform according to claim 1, wherein the means for resisting shear forces comprise pad eyes evenly spaced apart on the periphery of the lower end of the tower and support guides through which shear piles extend.

5. A platform according to claim 4, comprising a pre-drilled template installed on sea bottom and fixed by fixing piles, the upper part of which is used as shear piles for the platform.

6. A platform according to claim 2, wherein the flexible piles comprise a sleeve fixed to the lower part of the tower and housing part of the piles extending through a layer of marine deposits.

7. A platform according to claim 3, wherein the floaters are divided into compartments, the floaters containing under normal conditions a quantity of water equal to the volume of one compartment uniformly distributed among the compartments.

* * * * *

UNITED STATES PATENT AND TRADEMARK OFFICE

CERTIFICATE OF CORRECTION

PATENT NO. : 4,684,292

DATED : August 4, 1987

INVENTOR(S) : LOIC M.J. DANGUY des DESERTS et al

It is certified that error appears in the above-identified patent and that said Letters Patent is hereby corrected as shown below:

Title page

Column 1, after "(22) Filed: Aug. 12, 1985" insert

--Foreign Appln. Priority - August 10, 1984 France 84 12650--.

IN THE SPECIFICATION:

Column 1, line 42, delete "absornal" and insert --abnormal--;

line 55, delete "the" and insert --The--.

IN THE CLAIMS:

Claim 2, line 3, delete "to" and insert --the--.

Signed and Sealed this

Twenty-second Day of December, 1987

*Attest:*

DONALD J. QUIGG

*Attesting Officer*

*Commissioner of Patents and Trademarks*